US007798923B2

(12) United States Patent
Herman et al.

(10) Patent No.: US 7,798,923 B2
(45) Date of Patent: Sep. 21, 2010

(54) LACROSSE HEAD WITH SIDEWALLS OF ASYMMETRICAL HEIGHT

(75) Inventors: Craig M. Herman, Pleasant Ridge, MI (US); Joshua G. Schmidt, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 283 days.

(21) Appl. No.: 12/119,005

(22) Filed: May 12, 2008

(65) Prior Publication Data

US 2008/0287227 A1 Nov. 20, 2008

Related U.S. Application Data

(60) Provisional application No. 60/917,950, filed on May 15, 2007.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| 2,508,519 | A * | 5/1950 | Jay | 473/513 |
| 3,473,806 | A * | 10/1969 | Patterson | 473/513 |
| D248,679 | S | 7/1978 | Rule | |
| D263,249 | S | 3/1982 | Rule | |
| D265,845 | S | 8/1982 | Brine, Jr. et al. | |
| D277,691 | S | 2/1985 | Rule | |
| D286,666 | S | 11/1986 | Brine, Jr. | |
| D286,803 | S | 11/1986 | Brine, Jr. | |
| 5,048,843 | A | 9/1991 | Dorfi et al. | |
| D376,183 | S | 12/1996 | Morrow et al. | |
| 5,651,549 | A | 7/1997 | Dill et al. | |
| 5,935,026 | A | 8/1999 | Dill et al. | |
| 5,957,791 | A | 9/1999 | Nichols et al. | |
| 5,967,912 | A | 10/1999 | Hexemer et al. | |
| 6,506,132 | B1 | 1/2003 | Brine, III et al. | |
| 6,561,932 | B2 | 5/2003 | Morrow et al. | |
| RE38,216 | E | 8/2003 | Morrow et al. | |
| 6,676,547 | B1 | 1/2004 | Morrow et al. | |
| 6,752,730 | B1 | 6/2004 | Brine, Jr. et al. | |
| 6,902,501 | B2 | 6/2005 | Morrow et al. | |
| 6,921,347 | B1 | 7/2005 | Morrow et al. | |
| 6,926,628 | B2 | 8/2005 | Morrow et al. | |
| 6,929,572 | B2 | 8/2005 | Morrow et al. | |

(Continued)

OTHER PUBLICATIONS

Webpage download,Stick Tech Workshop,2004,http://www.e-la-crosse.com/stech59.php,14 pages.*

*Primary Examiner*—Gene Kim
*Assistant Examiner*—M Chambers
(74) *Attorney, Agent, or Firm*—Warner Norcross & Judd LLP

(57) ABSTRACT

A lacrosse head in which one of the opposing sidewall portions is shortened by bringing its lower rim upward relative to the corresponding lower rim of the opposing sidewall. At the same time, the upper rim of each of the opposing sidewalls is maintained at the same level. This moves the pivot point of the shortened sidewall closer to the player's hands and allows faster clamping when facing-off. Faster clamping likely results in an increased number of "wins", or possessions, that occur after the face-off.

19 Claims, 2 Drawing Sheets

U.S. PATENT DOCUMENTS

| | | | |
|---|---|---|---|
| 6,994,640 | B2 | 2/2006 | Morrow et al. |
| 7,022,035 | B2 | 4/2006 | Morrow et al. |
| 7,192,369 | B2 | 3/2007 | Morrow |
| 7,211,009 | B2 | 5/2007 | Samaras et al. |
| 7,226,374 | B2 | 6/2007 | Morrow et al. |
| 7,258,634 | B2 | 8/2007 | Morrow et al. |
| 7,264,562 | B2 | 9/2007 | Morrow et al. |
| RE40,182 | E | 3/2008 | Morrow |
| 7,357,739 | B2 | 4/2008 | Montano et al. |

* cited by examiner

LACROSSE HEAD WITH SIDEWALLS OF ASYMMETRICAL HEIGHT

CROSS-REFERENCED TO RELATED APPLICATIONS

The present invention claims priority from U.S. Provisional Patent Application Ser. No. 60/917,950, filed May 15, 2007 and entitled "Lacrosse Head with Sidewalls of Asymmetrical Height."

TECHNICAL FIELD

The present invention relates generally to a lacrosse head for attachment to a lacrosse handle. More particularly, the present invention relates to a lacrosse head that is constructed with sidewalls of asymmetrical height.

BACKGROUND OF THE INVENTION

Current lacrosse heads are typically constructed of an open frame having a ballstop with a concave interior surface that defines a ball rest, a pair of sidewalls that diverge from the ballstop, and a lip or scoop that interconnects the sidewalls remotely of the ballstop. Openings or other attachment structures are carried by the frame for securing a lacrosse net around the back side of the frame, leaving the opposing front side of the frame open for receiving lacrosse balls. A throat or other structure exteriorly projects rearwardly from the ballstop of the frame and has a socket formed therein for attachment to a handle. The handle and throat attachment define a handle/head axis, which typically forms the central axis and/or an axis of lateral symmetry of the head. All or at least a major portion of the front side of the head has been disposed in a plane parallel to the handle/head axis.

More recently, however, lacrosse heads have been commercially introduced that have at least a portion of the sidewall disposed below the handle/head axis. For example, U.S. Pat. No. 5,568,925 to Warrior Lacrosse discloses one embodiment for a lacrosse head where the sidewall curves downward below and away from the handle/head axis and then curves upward back toward the axis. The lacrosse head possesses numerous advantages over conventional lacrosse head constructions in which the front side of the frame is disposed essentially or entirely in a plane that lies parallel to the upper surface of the lacrosse stick. With this configuration, the pocket of the net will typically have a deeper construction than with conventional heads, such that the lacrosse ball lies a further distance below the upper rims of the sidewalls. Moreover, this configuration provides a greater distance for the ball to travel in the net during a throwing motion, thereby improving both ball speed and "feel" and also improves ball retention capabilities.

Other lacrosse heads have been commercially introduced that abruptly lower the sidewall of the lacrosse head such that the upper rims of the sidewalls lie at or below the centerline of the lacrosse stick. Purported examples of these commercial lacrosse heads are disclosed in U.S. Pat. Nos. 5,651,549 and 5,935,026. According to these patents, lacrosse heads of this configuration can provide a lacrosse stick that has a weight distribution between the stick head and handle such that the head will naturally return to a neutral or open position. Also, according to these patents, this configuration can provide improved player feel, which facilitates cradling, throwing and receiving of a ball. Furthermore, the head's natural rotation to an open position as disclosed in these patents minimizes the chance of a player unintentionally receiving a thrown ball with the wrong side of a lacrosse head.

While these newer head configurations have provided different and improved characteristics with regard to playability and feel that occur during the typical portion of a game of lacrosse, they do not provide any perceived benefit to a player conducting a face-off. Face-offs occur to start each quarter of a lacrosse game and after each goal. To conduct a face-off, the lacrosse ball is placed on the ground and two face-off-men lay their sticks horizontally next to the ball, with the head of the lacrosse stick inches from the ball, one of the sidewalls lies in close proximity to the ground while the opposing sidewall is vertically displaced relative to the one sidewall opposite the ground. In this position, the butt-end of the attached handle points down the midfield line. Face-off-men scrap for the ball, often by clamping it under the backside of their lacrosse head and flicking it out to their midfielders, who start on the wing restraining line near the sideline and sprint in when the whistle is blown to start play. Attackers and defenders cannot cross their "restraining line" until one player from the midfield takes possession of the ball.

To achieve this clamping maneuver, a player will rotate the lacrosse stick from a position wherein one sidewall is directly above the other sidewall to a position wherein the backside of the lacrosse head covers the ball and wherein the pair of opposing sidewalls are in close proximity to the ground. To achieve this quickly, the player maintains the one sidewall in close proximity to the ground and pivots the head about a pivot point defined by the sidewall ninety degrees such that the ball is covered between the backside of the sidewalls (i.e. the netting overlies the ball). The quicker a player can rotate the lacrosse head, the more likely the player is to "win" the face-off, and the more opportunities his or her team has to win possession of the ball and score goals.

The importance of a face-off in the game of lacrosse cannot be understated. A good face-off man can be crucial to the success of a lacrosse team. As a result, many teams have designated face-off men that conduct face-offs and then run off the field and are replaced by other players. Given the importance of the face-off, it is highly desirable to fashion a lacrosse stick that provides attributes that are likely to lead to an increased percentage of "wins", corresponding to an increased number of possessions for the lacrosse team.

SUMMARY OF THE INVENTION

It is therefore an advantage of the present invention to provide a lacrosse head that is ideally suited for taking face-offs in the game of lacrosse.

It is another advantage of the present invention to provide a lacrosse head that provides improved face-off performance capabilities.

In accordance with the above and the other advantages of the present invention, a lacrosse head that is ideally suited for use in face-offs is provided. The lacrosse head includes an open frame element having a ballstop portion, a pair of opposing sidewall portions, and a scoop portion. In a preferred embodiment, one of the opposing sidewall portions is shortened by bringing its lower rim upward relative to the corresponding lower rim of the opposing sidewall. At the same time, the upper rim of each of the opposing sidewalls is maintained at the same level. This moves the pivot point of the shortened sidewall closer to the player's hands and allows faster clamping when facing-off. Faster clamping likely results in an increased number of "wins", or possessions, that occur after the face-off.

Other advantages and features of the present invention will become apparent when viewed in light of the detailed description and preferred embodiment when taken in conjunction with the attached drawings and claims.

DETAILED DESCRIPTION OF PREFERRED EMBODIMENT

Figures 1, 2, 3, 4, 5:
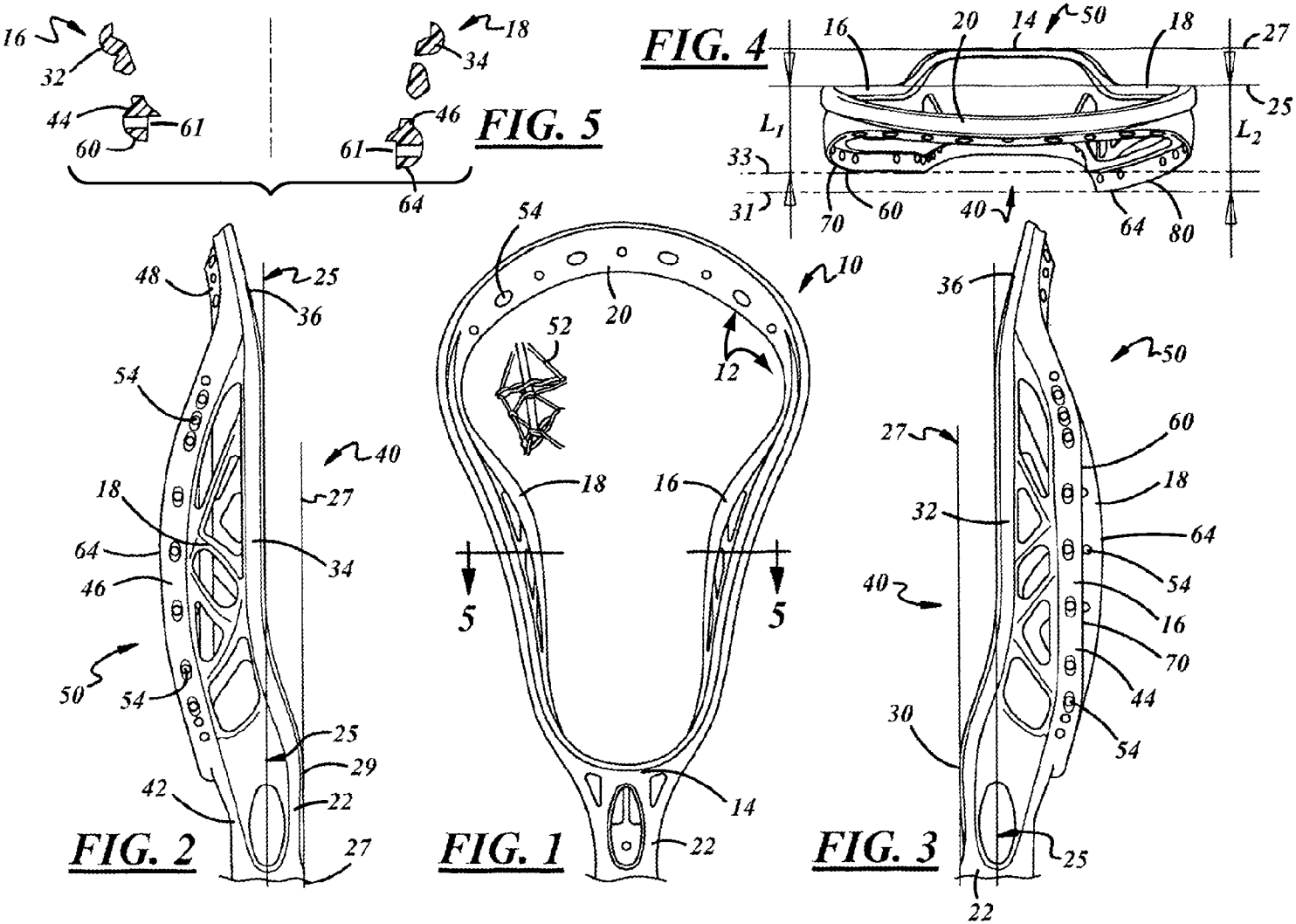
FIG. 1 is a top view of a lacrosse head in accordance with one embodiment of the present invention.
FIG. 2 is a left side view of the lacrosse head of FIG. 1.
FIG. 3 is a right side view of the lacrosse head of FIG. 1.
FIG. 4 is an end view of the lacrosse head of FIG. 1.
FIG. 5 is a sectional view of the lacrosse head of FIG. 1 taken along line 5-5.

In the following figures, the same reference numerals are used to identify the same components in the various views.

Referring now to the Figures, which illustrate a lacrosse head in accordance with the present invention. In one embodiment a lacrosse head is constructed of a polymeric plastic material. However, in accordance with the present invention and, as discussed in more detail below, the lacrosse head can be formed of a variety of different polymeric, non-polymeric, or composite materials as desired.

As shown in FIGS. 1 through 5, the lacrosse head 10 has a frame element 12, which includes a base or ballstop portion 14, a pair of opposing sidewall portions 16, 18, and a scoop portion 20 connecting the pair of opposing sidewall portions 16, 18 opposite the ballstop portion 14. It will be understood that the frame element 12 can take on varying configurations. Further, each of the portions of the frame element 12 can also take on varying configurations. The lacrosse head 10 has a throat portion or socket 22 that extends generally rearwardly from the frame element 12 for attachment of a stick handle (not shown) or element thereto. It will also be understood that the throat portion or socket 22 can take on a variety of different configurations so long as it allows a handle to be attached to or mated with the head 10 to form a complete stick. Further, while the head 10 and the handle are discussed as separate components, it will be understood that they can be permanently attached to one another or can be formed as a single unitary structure.

Moreover, the length of the lacrosse handle defines a first horizontal reference plane 25 that coincides with its upper surface or a majority of its upper surface. A second horizontal reference plane 27 is located at a top surface 29 of the throat portion 22 and is oriented generally parallel to the first horizontal reference plane 25. It will be understood that the planes 25 and 27 are merely reference planes that are intended to allow for orientation of other components of the head. It will also be understood that the planes 25 and 27 are not structural elements of the lacrosse head 10.

The upper rim 30 of the ballstop portion 14 and the upper rims 32, 34 of the sidewall portions 16, 18 respectively together, in connection with the top 36 of the scoop portion 20, define a ball receiving area 40. Further, the lower rim 42 of the ballstop portion 14 and the lower rims 44, 46 of the sidewall portions 16, 18 respectively together, in connection with the bottom 48 of the scoop portion 20, define a ball retention area 50. The ball receiving area 40 is functionally the portion of the head 10 where the lacrosse ball can enter or exit the head 10 such as when caught, thrown, shot, thrown or dislodged. The ball retention area 50 is functionally the portion of the head 10 where the lacrosse ball typically resides when retained in the head 10 and where the netting 52 is generally attached to the head 10.

Additionally, the frame element 12 includes a plurality of net securing structures 54 formed therethrough to allow attachment of the netting 52. The net securing structures 54 are preferably stringing holes that are formed through the head 10 and are preferably formed adjacent the ball retention area 50. However, it will be understood that a variety of other net securing structures 54 may be utilized. Further, the net securing structures 54 may also be formed in other locations on the frame element 12 to provide varying locations for attachment of the netting 52 to provide varying pocket configurations and depths for different playability characteristics. Additionally, the frame element 12 may have multiple different net securing structures 54 disposed in different locations height-wise on the frame element 12 to allow the netting 52 to be attached to the head 10 in multiple positions as desired by a player.

As best shown in FIGS. 4 and 5, the lowest portion 60 of the lower rim 44 of one of the respective sidewalls 16 is raised or lies closer to the horizontal planes 25 and 27 than the corresponding lowest portion 64 of the lower rim 46 of the other respective sidewall 18. In other words, the distance L1, defined by the distance between the lowest portion 60 of sidewall 16 and the horizontal plane 25, is smaller or less than the distance L2 between the lowest portion 64 of sidewall 18 and the horizontal plane 25. This moves the pivot point 70 of the sidewall 16, which is defined by the lowest portion 60, closer to the respective horizontal planes 25 and 27. This also creates a lacrosse head having an asymmetrical shaped sidewall design, as opposed to conventional lacrosse heads which have a symmetrically shaped sidewall design.

In another embodiment, the majority of the lower rim 44 lies closer to the reference plane 25 than the lower rim 46. In this embodiment, the majority of the sidewall 16 has less height than the opposing sidewall 18. In still another embodiment, the entirety of the lower rim 44 can lie closer to the reference plane 25 than the lower rim 46.

The movement of the pivot point 70 location closer to the horizontal planes 25 and 27, allows a player to more quickly pivot the lacrosse head about the pivot point 70 during a face-off maneuver from a face-off position to a clamping position. The face-off position is defined wherein the lacrosse stick is placed horizontally next to the ball located on the ground, with the head 10 of the lacrosse stick inches from the ball, with one of the sidewall portions 16 in close proximity to the ground while the opposing sidewall portion 18 is vertically displaced relative to the one sidewall portion 16 opposite the ground and wherein the butt-end of the lacrosse handle is pointing down the midfield line. The clamping position is defined wherein the head 10 is rotated approximately at an angle $\alpha$ between about 75 and slightly less than 90 degrees about the pivot point 70 such that the back side portion 80 of the lacrosse head 10 covers the lacrosse ball and such that the lower rims 44, 46 are parallel to and in close proximity with the ground and surround the ball.

A related and additional benefit that is also gleaned during the clamping maneuver is that the lowest portion 64 of the opposing sidewall 18 contacts the ground when the head is pivoted about the pivot point 70 wherein angle $\alpha$ is less than about 90 degrees. Contrast this with a conventional lacrosse head having symmetrical sidewalls, which would require a rotation of 90 degrees to the clamping position. A lacrosse player can thus more quickly rotate the lacrosse head over the ball to the clamping position, even without increasing the rate of rotation. This, as one of ordinary skill in the art would recognize, could result in an increase in the number of "wins" and resultant possessions by a lacrosse team during the course of a lacrosse game, which is a highly desired result. Additionally, the shorter sidewall allows a player to line up slightly closer to the ball during the face-off.

In addition, as best shown, in FIGS. 3 and 4, in a preferred embodiment, the lowest portion 60 of the lower rim 44, along a majority of its length in the direction from the ballstop portion 14 to the scoop portion 20, is substantially parallel to the first horizontal plane 25 and second horizontal plane 27. In other words, the lowest portion 60 is substantially flat and parallel to the first horizontal plane 25 and second horizontal plane 27. This increases the length of the pivot point 70 as the head is rotated from the face-off position to the clamping position, which helps to ensure that the entirety of the length of the lower portion 64 of the lower rim 46 contacts the ground at substantially the same time as the stick is rotated to the clamping position, which helps to ensure that the lacrosse ball is captured between the sidewalls 16, 18 and maintained along the back side portion 80 of the frame 12. This assists in preventing the ball from escaping out from a location nearer to the scoop portion 20 or ballstop portion 14 if the head is angled forwardly or rearwardly as the head 10 is rotated from the face-off position to the clamping position. One of ordinary skill would realize the benefit of this increased ball retention aspect.

Figure 6:
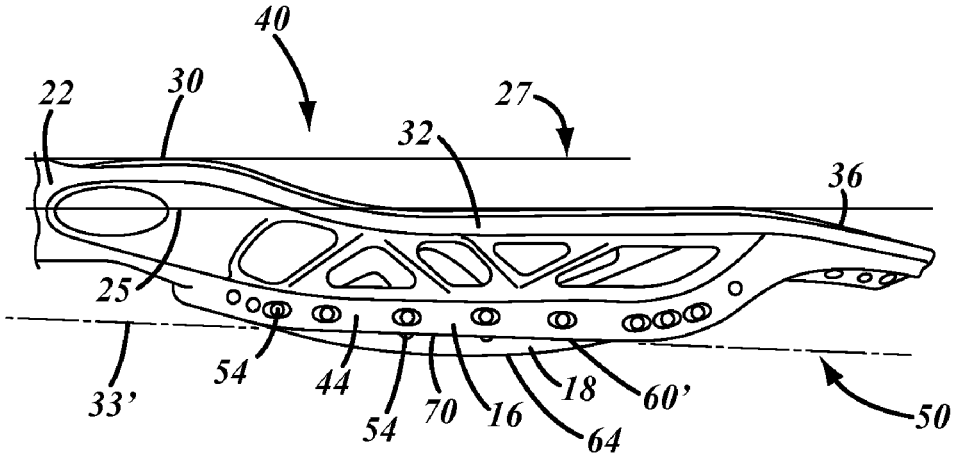
FIG. 6 is a right side view of a lacrosse head in accordance with one embodiment of the present invention.
Figure 7:
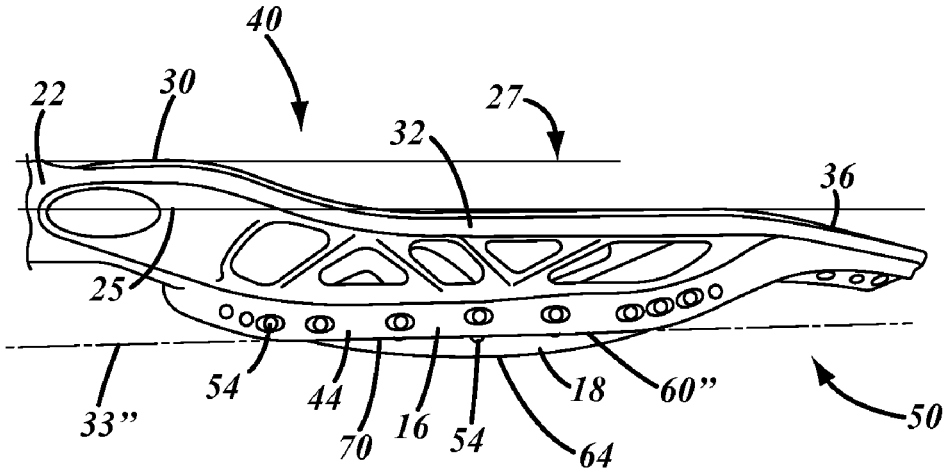
FIG. 7 is a right side view of a lacrosse head in accordance with one embodiment of the present invention.

In other alternative embodiments, the lowest portion 60 of the lower rim 44 may be substantially flat along its length, but may define a reference plane that is non-parallel with respect to the first horizontal plane 25 and second horizontal plane 27 (i.e. angled with respect to the first horizontal plane 25 and second horizontal plane 27). This angling may be slightly upward towards the scoop 20, as shown by reference plane 33" in FIG. 7 or slightly upward towards the ball stop 14, as shown by reference plane 33' in FIG. 6.

In yet another alternative embodiment, the lowest portion 60 of the lower rim 44 may be slightly shaped in a regular or irregular manner along its length but remain essentially parallel along the entirety of its length with respect to the first horizontal plane 25 and second horizontal plane 27. For example, the lowest portion 60 may have a slight c-shape (with the concavity facing the first horizontal plane 25 and second horizontal plane 27 along its length from the ballstop 14 to the scoop 20.

In another example, a portion of the lowest portion 60 nearer to the ballstop 14 may be substantially flat while another portion of the lowest portion 60 may be angled or slightly curved upward towards the scoop 20 and still fall within the spirit of the present invention. The opposite is also contemplated wherein a portion of the lowest portion 60 nearer to the scoop 20 may be substantially flat while another portion of the lowest portion 60 may be angled or slightly curved upward towards the ballstop 14 and still fall within the spirit of the present invention.

As also shown in FIGS. 4 and 5, the net securing structures 54 of the lower rim 44 are also slightly raised towards the first horizontal plane 25 and second horizontal plane 27 than the corresponding net securing structures of the lower rim 46. The attached netting 52 is thus correspondingly raised. In accordance with another embodiment, the sidewalls 16 can have a second row or set of string holes formed therein that is at the same level as the net securing structures 54 of the sidewall 18 such that the pocket is level.

However, it is also contemplated that the net securing structures 54 of both lower rims 44 and 46, in other alternative embodiments, may be substantially the same distance from the horizontal planes 25 and 27 and still fall within the spirit of the present invention. In this arrangement, the netting 52 may more quickly contact and cover the lacrosse ball as the lacrosse stick is rotated from the face-off position to the clamping position, potentially allowing a player increase the number of "wins" in face-offs.

In yet another alternative arrangement, the lower rims 44, 46 may include a recessed channel 61 (FIG. 5) along their inner surfaces that aid in ball retention when the ball is cradled within the stick and aid in reducing netting wear when the net securing structures are located within the recessed channels. The recessed channels 61 may also potentially change the netting configuration and its effects on contacting the lacrosse ball during face-offs.

It will be understood that the methods of the present invention can yield a variety of different types of lacrosse heads and is thus not limited to the proposed arrangement shown in FIGS. 1 through 5. Thus, lacrosse sticks with different ballstop, sidewall, or scoop design configurations having the shortened or asymmetrical sidewall design of the present invention are specifically contemplated.

In addition, the present invention illustrates a configuration where the lowest portion 60 of sidewall 16 is raised closer to horizontal plane 25 than the lowest portion 64 of sidewall 18. However, it is recognized that a lacrosse head formed with the opposite arrangement is contemplated, wherein the lowest portion 64 of sidewall 18 is raised closer to horizontal plane 25 than the lowest portion 60 of sidewall 16, and still fall within the spirit of the present invention.

While particular embodiments of the invention have been shown and described, numerous variations and alternate embodiments will occur to those skilled in the art.

What is claimed is:

1. A lacrosse head comprising:

a frame element including a base portion, a scoop portion located opposite to said base portion, a throat portion extending rearwardly from said base portion and adapted to join with a lacrosse stick handle, and a pair of rigid opposing sidewall portions integrally formed with and extending between said base portion and said scoop portion so that said sidewall portions, said base portion and said scoop portion are monolithic;

wherein each of said pair of sidewalls includes an upper rim and a lower rim;

a first horizontal reference plane defined by an upper surface of said lacrosse stick handle;

a second horizontal reference plane defined by a top surface of said throat portion, said first horizontal reference plane being parallel to said second horizontal reference plane;

wherein the lowest portion of said lower rim on one of said pair of opposing sidewalls and said first horizontal plane define a first distance there between;

wherein the lowest portion of said lower rim on the other of said pair of opposing sidewalls and said first horizontal plane define a second distance there between; and wherein said second distance is greater than said first distance, wherein a majority of a lower surface of said lower rim of said other of said opposing pair of sidewalls lies at a distance farther away from said first horizontal plane than a corresponding lower surface of said lower rim of said one of said pair of opposing sidewalls.

2. The lacrosse head of claim 1, wherein the entirety of a lower surface of said lower rim of said another of said opposing pair of sidewalls lies at a distance further away from said first horizontal plane than a corresponding lower surface of said lower rim of said one of said pair of opposing sidewalls.

3. The lacrosse head of claim 1, wherein an upper surface of each said upper rims defines a plane there between, said plane being substantially parallel with said first horizontal plane and said second horizontal plane.

4. The lacrosse head of claim 1, wherein a majority of a lower surface of said lower rim of said one of said pair of opposing sidewalls is substantially flat along its length between said base portion and said scoop portion, said substantially flat length defining a reference plane that is generally parallel to said first horizontal plane and said second horizontal plane.

5. The lacrosse head of claim 1, wherein a majority of a lower surface of said lower rim of said one of said pair of opposing sidewalls is substantially flat along its length between said base portion and said scoop portion, said substantially flat length defining a reference plane that is generally angled with respect to said first horizontal plane and said second horizontal plane from said base portion to said scoop portion.

6. The lacrosse head of claim 5, wherein said reference plane is angled such that it is slightly closer to said first horizontal reference plane and said second horizontal reference plane at a position nearer to said scoop portion and wherein said reference plane is slightly further from said first horizontal reference plane and said second horizontal reference plane at a position nearer to said base portion.

7. The lacrosse head of claim 5, wherein said reference plane is angled such that it is slightly closer to said first horizontal reference plane and said second horizontal reference plane at a position further from said scoop portion and wherein said reference plane is slightly closer to said first horizontal reference plane and said second horizontal reference plane at a position nearer to said base portion.

8. The lacrosse head of claim 1, wherein a majority of a lower surface of said lower rim of said one of said pair of opposing sidewalls is c-shaped along its length between said base portion and said scoop portion, said c-shaped length defining a reference plane that is generally parallel to said first horizontal plane and said second horizontal plane.

9. The lacrosse head of claim 1, wherein a majority of a lower surface of said lower rim of said one of said pair of opposing sidewalls is regularly shaped along its length between said base portion and said scoop portion, said regularly shaped length defining a reference plane that is generally parallel to said first horizontal plane and said second horizontal plane.

10. The lacrosse head of claim 8, wherein the concavity of said c-shape faces said first horizontal plane and said second horizontal plane.

11. The lacrosse head of claim 1, wherein a first portion of a lower surface of said lower rim of said one of said pair of opposing sidewalls extending from said base portion is substantially flat along its length, said substantially flat length defining a reference plane that is generally parallel with respect to said first horizontal plane and said second horizontal plane; and wherein a second portion of said lower surface of said lower rim of said one of said pair of opposing sidewalls curves slightly upward towards said first horizontal plane and said second horizontal plane along its length from said first portion towards said scoop portion.

12. The lacrosse head of claim 1, wherein a first portion of a lower surface of said lower rim of said one of said pair of opposing sidewalls extending from said scoop portion is substantially flat along its length, said substantially flat length defining a reference plane that is generally parallel with respect to said first horizontal plane and said second horizontal plane; and wherein a second portion of said lower surface of said lower rim of said one of said pair of opposing sidewalls curves slightly upward towards said first horizontal plane and said second horizontal plane along its length from said first portion towards said base portion.

13. The lacrosse head of claim 1 further comprising a plurality of net securing structures coupled within an interior surface of each of said lower rims of said pair of opposing sidewalls.

14. The lacrosse head of claim 13, wherein at least one of said net securing structures is located within a recessed channel located along said interior surface.

15. A lacrosse stick comprising:

a frame element including a base portion, a scoop portion located opposite to said base portion, a throat portion extending rearwardly from said base portion, and a pair of rigid opposing sidewall portions integrally formed with and extending between said base portion and said scoop portion, wherein the opposing sidewall portions, said base portion and said scoop portions are monolithic, wherein each of said pair of sidewalls includes an upper rim and a lower rim;

a plurality of net securing structures coupled within an interior surface of said base portion, said scoop portion and said pair of opposing sidewalls;

a net coupled to said frame element through said plurality of net securing structures;

a lacrosse stick handle coupled within said throat portion, said lacrosse handle having an upper surface defining a first horizontal plane;

a second horizontal reference plane defined by a top surface of said throat portion, said first horizontal reference plane being parallel to said second horizontal reference plane;

wherein the lowest portion of said lower rim on one of said pair of opposing sidewalls and said first horizontal plane define a first distance there between;

wherein the lowest portion of said lower rim on the other of said pair of opposing sidewalls and said first horizontal plane define a second distance there between; and wherein said second distance is greater than said first distance, wherein a majority of a lower surface of said lower rim of said other of said opposing pair of sidewalls lies at a distance farther away from said first horizontal plane than a corresponding lower surface of said lower rim of said one of said pair of opposing sidewalls.

16. The lacrosse stick of claim 15, wherein a majority of a lower surface of said lower rim of said one of said pair of opposing sidewalls is substantially flat along its length between said base portion and said scoop portion, said substantially flat length defining a reference plane that is generally parallel to said first horizontal plane and said second horizontal plane.

17. The lacrosse stick of claim 15, wherein a majority of a lower surface of said lower rim of said one of said pair of opposing sidewalls is substantially flat along its length between said base portion and said scoop portion, said substantially flat length defining a reference plane that is generally angled with respect to said first horizontal plane and said second horizontal plane from said base portion to said scoop portion.

18. The lacrosse stick of claim 15, wherein a majority of a lower surface of said lower rim of said another of said opposing pair of sidewalls lies at a distance further away from said first horizontal plane than a corresponding lower surface of said lower rim of said one of said pair of opposing sidewalls.

19. A method for forming the lacrosse stick head of claim 1 or claim 15 that is ideally suited for face-offs, the method comprising:

transforming a material to make a frame element, the frame element including a base portion, a scoop portion located opposite to said base portion, a throat portion extending rearwardly from said base portion and intended to receive a lacrosse stick handle, and a pair of rigid opposing sidewall portions integrally formed with and extending between said base portion and said scoop portion, wherein each of said pair of sidewalls includes an upper rim having an upper surface and a lower rim having a lower surface;

defining a first horizontal reference plane with an upper surface of said lacrosse stick handle, wherein said lacrosse stick handle is coupled with said base portion;

defining a second horizontal reference plane with a top surface of said throat portion, said first horizontal reference plane being parallel to said second horizontal reference plane; and decreasing the distance between said upper surface of said lacrosse stick handle and said lower surface of said lower rim of one of said pair of opposing sidewalls while maintaining the distance between said upper surface of said lacrosse stick handle and said lower surface of said lower rim of the other of said pair of opposing sidewalls;

wherein an uppermost surface of said upper rims of each of opposing sidewalls defines a reference plane, said reference plane being parallel to both said first horizontal plane and said second horizontal plane.

* * * * *